United States Patent [19]
Weil
[11] 4,287,844
[45] Sep. 8, 1981

[54] BULKY COMPOSITE FABRIC AND METHOD OF MAKING SAME

[75] Inventor: Thomas L. Weil, Elverson, Pa.

[73] Assignee: Bentley-Harris Manufacturing Company, Lionville, Pa.

[21] Appl. No.: 32,960

[22] Filed: Apr. 24, 1979

[51] Int. Cl.[3] ..... D05B 93/00
[52] U.S. Cl. ..... 112/412; 112/441; 112/262.1; 112/261.1
[58] Field of Search ..... 112/441, 401, 402, 412, 112/440, 262.1, 262.2, 265.1, 268.1, 269.1; 66/79, 81, 9 A, 195

[56] References Cited

U.S. PATENT DOCUMENTS

| | | | |
|---|---|---|---|
| 2,512,959 | 6/1950 | Mintel | 112/412 |
| 2,748,448 | 6/1956 | Menzies et al. | 112/412 |
| 3,390,602 | 7/1968 | Ohno | 112/412 UX |
| 4,047,402 | 9/1977 | Matsuda et al. | 66/195 |
| 4,123,830 | 11/1978 | Matsuda et al. | 60/195 |

FOREIGN PATENT DOCUMENTS

| | | | |
|---|---|---|---|
| 48-586 | of 1973 | Japan | 60/81 |

*Primary Examiner*—Ronald Feldbaum
*Attorney, Agent, or Firm*—Dann, Dorfman, Herrell & Skillman

[57] ABSTRACT

A composite bulky fabric of narrow width having lengthwise extensibility and widthwise dimensional stability in which the fabric is made up of a plurality of flattened tubular-knit components disposed in edge-to-edge juxtaposed position and interconnected by seams extending along the junction and formed of a zigzag line of stitching, the knitted tubular components being formed of a non-run stitch comparable to a tricot stitch formation. The tubular knit components are preferably knit on a small diameter knitting machine having a reciprocating feed for each of the needles so that the feed reciprocates between a pair of adjacent needles, and is supplied from a creel or other stationary supply.

The products made in accordance with the invention are useful for thermal and electrical insulating, gasketing, padding, sealing and similar purposes.

The novel method for producing the fabric is diagrammed in FIG. 6.

12 Claims, 6 Drawing Figures

BULKY COMPOSITE FABRIC AND METHOD OF MAKING SAME

FIELD OF THE INVENTION

The present invention relates to tapes or narrow fabrics used for gasketing, insulating, padding, sealing, and the like, and has particular application to fabrics made of fiberglass and similar filamentary material which has properties particularly suited to the desired end use.

BACKGROUND OF THE INVENTION

In the past, asbestos has been the principal material used for heat insulation and sealing where the material is subjected to elevated temperatures. Asbestos fibers are plentiful and are readily combined into laps, roving, and yarn for various end uses by conventional textile apparatus. Asbestos materials tend to flake or slough off fibers unless specially treated, but such tendency has not been a significant deterrent to the use of asbestos because of its abundant supply and relative ease of handling in manufacturing.

In recent years, fiberglass has been developed as a substitute for asbestos where the coarseness of the asbestos material is unsuitable for the end use and where the fine filamentary characteristics of fiberglass provide properties which justify the normally higher cost of substituting fiberglass for asbestos.

A significant advantage of fiberglass is that it has considerable tensile strength in comparison to asbestos and in continuous-filament fiberglass products, the fiberglass tensile strength is relatively independent of the degree of twist in the fiberglass strands so that fiberglass may be fabricated with a looser or less compact fibrous structure.

SUMMARY OF THE INVENTION

With the foregoing in mind, the present invention provides an improved fabric which is produced in a highly efficient operation and yet which has characteristics which are comparable to or are improvements over the characteristics of fabrics formed with less expensive material by conventional techniques.

More specifically, the present invention provides an improved narrow fabric in which the fabric has high widthwise dimensional stability with a reasonable degree of lengthwise extensibility which permits the fabric to be formed around corners without sacrificing its flat characteristics.

The fabric of the present invention exhibits substantial heat-insulating characteristics which enables it to be used as a spacer element between components having different temperatures.

The present invention also provides a fabric element which has a degree of porosity which inhibits direct airflow through the fabric yet which permits limited breathing to avoid explosive containment.

The present invention provides a highly economical and effective procedure for fabricating fiberglass material into composite fabrics having substantial bulk and high density to enhance the utility of such fabrics in gasketing, insulating, padding, sealing and similar uses.

More specifically, the present invention provides a composite fabric consisting of a plurality of tubular-knitted components which are joined in side-by-side juxtaposed relation by seams, the dimensions of the components being such as to provide dimensional stability to the fabric in a widthwise direction while affording limited extensibility lengthwise.

DESCRIPTION OF THE DRAWING

All of the objects of the invention are more fully set forth hereinafter with reference to the accompanying drawing, wherein.

DESCRIPTION OF THE PREFERRED EMBODIMENTS

Figure 1:
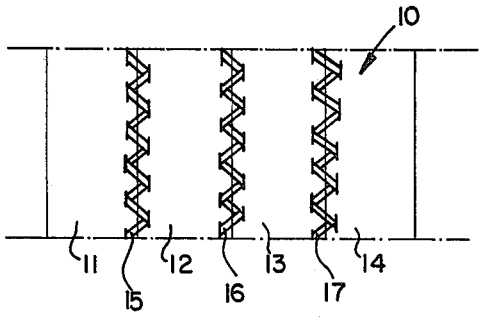
FIG. 1 is a diagrammatic illustration of a composite fabric embodying the present invention.

Referring now to the drawing, FIG. 1 diagrams a composite fabric made in accordance with the present invention. In the embodiment of FIG. 1, the composite fabric 10 is made up of four individual fabric components designated 11, 12, 13 and 14 respectively in FIG. 1. The components are positioned side-by-side and are interconnected by seams 15, 16 and 17 extending along the line of junction between the juxtaposed components. The components are of indeterminate lengths so that the illustration in FIG. 1 represents a typical segment of a continuous length of composite fabric. As shown, the width of the composite fabric 10 is equal to the sum of the width of the individual components 11, 12, 13 and 14.

Figure 2:
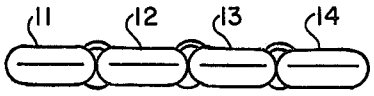
FIG. 2 is a diagrammatic transverse section view taken through the fabric of FIG. 1.

In accordance with the present invention, each of the components is a tubular knit fabric and as shown in FIG. 2, the flattened fabric has an ovate cross section which closes the interior bore of the tubular fabric so that the interior surface at one side of the tubular component is in engagement with the interior surface at the opposite side. As indicated in FIGS. 1 and 2, each of the seams 15, 16 and 17 consists of a zigzag line of stitching which, in the present instance, is made by a chain-stitch sewing machine which produces a double line of stitching at the looper side of the fabric and a single line of thread at the needle side of the fabric. The zigzag sewing machine operates in a fashion that the needle alternately penetrates the edge portions of the juxtaposed fabric components as they travel past the needle in side-by-side relation thereby causing the stitch segments of the seam to be disposed diagonally alternately in opposite directions along the length of the junction line between the two components. The seams not only provide a secure interconnection between the components, but also permit the components to extend longitudinally while sewn together.

The use of tubular knit fabric components provides a firm self-edge when the components are flattened which enhances the interconnection of the components by the stitches of the seams. Furthermore, the outer edges of the composite fabric 10 are also provided with a firm self-edge. The self-edge formed by the flattened tubular knit fabric components is formed without the extra threads or different warp manipulation which is required in the selvage of woven fabrics. In the present instance, the self-edge is obtained by the simple expedient of flattening the tubular knit fabric.

A desirable characteristic of tubular knit fabric for the present purpose is its inherent characteristic of having limited widthwise extensibility while exhibiting substantial lengthwise extensibility. The lengthwise extension of the fabric tends to contract it widthwise but the close-knitted stitch formation in the tubular knit fabric of the present invention inhibits the lateral extension of the fabric component.

In accordance with another feature of the present invention, the knitted tubular components of the composite fabric are knitted compactly with a non-run stitch which enhances the dimensional stability and durability of the knitted product. To this end, the fabric components are each knitted on a knitter-braider manufactured by the Lamb Knitting Machine Corporation of Chicapee, Mass. This knitter-braider is a circular warp knitter having a circle of knitting needles mounted in a cylinder for vertical displacement between a stitch feed and a stitch draw position. Each needle has associated with it a feeder which is capable of feeding strand material to the needles from a creel or other fixed supply source. The needle cylinder is hollow to permit withdrawal of the knitted tube from the machine downwardly through the center of the cylinder, the needles being positioned externally of the cylinder so that the top of the cylinder serves to cast the previously-knitted loop from the needle as it is pressed downwardly to the stitch-draw level.

The yarn feeders reciprocate transversely between two needle stations in timed relation to the vertical reciprocation of the needles so that each feeder deposits a strand into the hook of the needle in the yarn feed position, on one needle at the first station in a first course and then on the other needle at the other station in the subsequent course. As the needle draws a stitch, it casts the stitch formed previously from an alternate yarn. In this fashion, the stitches in any given needle wale alternate between two feeds, the loops of the one strand alternating with the loops of the other strand. The strand forming the alternate loops form loops on the needles in a wale on one side of the given needle wale, while the intermediate loops are being formed on the needle in the given wale. Likewise, when the alternate loops are being formed on the needle in the given wale, the strand forming the intermediate loops are forming loops in a wale on the other side of the given wale.

Figure 3:
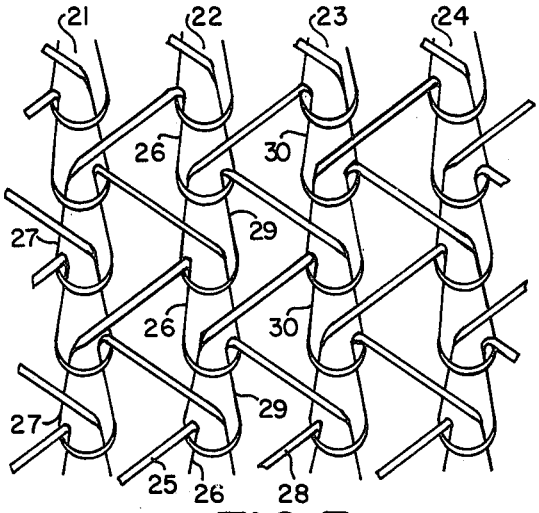
FIG. 3 is a schematic illustration of the stitch pattern embodied in the tubular fabric components of the present invention, the tubular fabric being split and opened out to facilitate the illustration of the stitch pattern.

FIG. 3 diagrams the stitch pattern produced by the knitter-braider when the feeder reciprocates between adjacent wales. In the illustration, four needle wales are illustrated, designated 21, 22, 23 and 24, respectively. With reference to the needle wale 22, it is noted that the strand 25 forms alternate needle loops 26 in the wale 22 and also forms intermediate needle loops 27 in the wale 21. A second strand 28 forms intermediate needle loops 29 in the wale 22 as the strand 25 forms the loops 27 in the wale 21. When the strand 25 forms the loops 26 in wale 22, the strand 28 forms loops 30 in the wale 23 on the opposite side of the wale 22 from the wale 21. The bight of the needle loops is shown in double lines in FIG. 3 to indicate that they appear on the same surface of the fabric as the stitch connectors extending diagonally between the needle loops, which are also shown in double lines. The single line portions of the needle loops shown in FIG. 3 appear on the reverse face of the fabric. In the preferred embodiment of the invention, the Lamb knitter-braider is a four-needle machine which forms four needle wales spaced circumferentially about the tubular fabric. With reference to FIG. 3, the tubular fabric produced by the knitter-braider has only four wales 21, 22, 23 and 24, the wale 24 being formed adjacent the wale 21 to make a continuous tubular fabric.

On the knitting machine, the non-run stitch pattern is obscured because of the tension applied to the strand during the knitting operation. The tension on the strand causes the knitted loops to assume angular positions in which the bases of the loops 26 and 30 are canted toward the left relative to the bights thereof and the bases of the loops 27 and 29 are canted toward the right relative to their bights. The overall effect of this structure is to produce a tubular knit fabric having an appearance of a braid. The alternation of the strands between the adjacent wales provides a non-run stitch pattern similar to the standard tricot stitch of the flat tricot machine.

The knitter-braider may also be adjusted to reciprocate the feeder between spaced-apart wales. For example in a machine with four needle stations, one feeder may reciprocate between stations 1 and 3, a second feeder may reciprocate between stations 2 and 4, a third between stations 3 and 1, and a fourth between stations 4 and 2. With this adjustment, the machine produces a tubular fabric having an appearance more like a knitted tube than like a braid, and the stitch connectors extend across the core of the fabric and tend to fill it up.

With either adjustment, the knitter-braider apparatus is particularly effective for use in the present invention since the machine is capable of knitting a wide variety of strand material which may vary in bulk from a fine thread to a bulky sliver or roving. Fiberglass roving is a bundle of fiberglass filaments which are assembled into a strand of considerable tensile strength without substantial twisting. For the purpose of the present invention where a bulky fabric is desired, it has been found that a fiberglass roving is particularly effective to provide the desired bulk. Since each feed mechanism of the knitter-braider operates in association with only two needle stations by arcuate oscillation between the two stations, the feeder may be fed from a stationary source without entanglement from strands being fed to other feed stations in the machine. Thus, the stationary supplies for each feeder may provide positive feeding or controlled feed of the strand material thereby insuring the desired geometry in the fabric produced by the knitter-braider.

Figure 6:
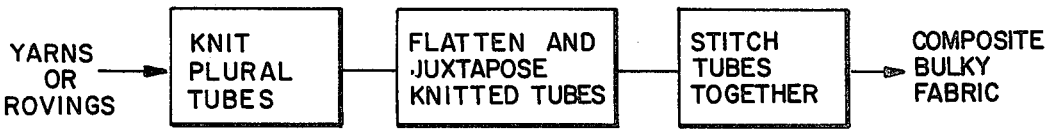
FIG. 6 is a schematic block diagram illustrating the method embodied in the production of a composite fabric in accordance with the present invention.

The components are then assembled by a zigzag sewing machine as diagrammed in FIG. 6. Preferably, the sewing machine is a chain stitch machine having a reciprocating needle on one side the work which cooperates with an oscillatory looper on the opposite side of the work. Following the schematic diagram of FIG. 6, the rovings which are employed to fabricate the individual components of the tape 10 are knitted in groups of four to form tubular knitted fabric components 11 through 14 of any desired length. These components are then fed through feed rollers which flatten the tubes and position them side-by-side so that a sewing machine may provide a seam such as indicated at 15, 16 and 17 in FIGS. 2 and 3. The tubular components may be all sewn together at the same time or they may be connected two at a time as desired, or as required by the capability of the sewing machine.

In the embodiment shown in FIGS. 1 and 2, the composite fabric produces a tape having a width corresponding to the accumulated with of the individual components which are connected to form the composite fabric. The longitudinal extensibility of the individual component and the use of a zigzag stitch seam to interconnect the juxtaposed components is particularly effective to provide longitudinal extensibility in the composite fabric. By reason of the stitch formation and the strand tension in the components, the lateral extensibility of the fabric is restricted so that the composite fabric has good lateral dimensional stability and provides a tape structure which is capable of withstanding harsh handling during use.

A preferred application for the tape of FIGS. 1 and 2 is for use as a framing gasket where it is desired to position the tape around the periphery of a frame to separate or insulate the frame from the underlying structure. The longitudinal extensibility of the composite fabric provides an ability for the fabric to lay flat as it is displaced into a curvilinear path at the corners of the frame element without bunching or creasing, which in conventional gasketing material provides open passageways which render the seal ineffective in the corners. With conventional inextensible gasket material, the bunching of the material in the corners is avoided by mitering the corners of the gasketing material and relying on the abutment of the mitered edges of the material in the corners of the frame. Obviously, inaccuracies in mitering the corners of the inextensible gasketing material enables the formation of gaps which destroy the effectiveness of the seal. By providing extensibility without creasing or bunching, the need for mitering is obviated in the present invention.

Figure 4:
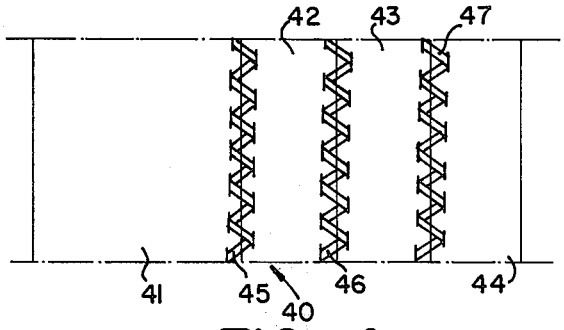
FIG. 4 is a diagrammatic view similar to FIG. 1 illustrating another embodiment of the present invention.
Figure 5:
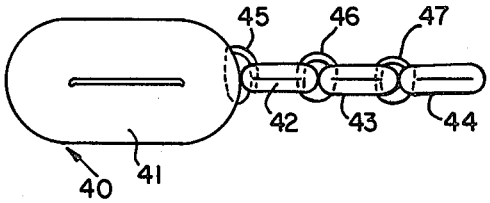
FIG. 5 is a diagrammatic transverse sectional view taken through the fabric of FIG. 4.

The invention is also effective to provide a tadpole tape of the character shown at 40 in FIGS. 4 and 5 in which one marginal portion of the tape is of substantially greater thickness than the other marginal portion. Such a tape is frequently used as a sealing gasket wherein the tail portion, i.e., the marginal portion of lesser thickness is used to mount the tape between a pair of confronting clamping elements. The body portion, i.e., the marginal portion of greater thickness, is left free to serve as a resilient sealing portion which may conform to irregularities in the surfaces between which it is positioned.

A tadpole tape of this character is formed in the same fashion as the tape of FIGS. 1 and 2 but instead of having all of the fabric components of the tape formed identically, one of the components 41 is formed with substantially greater bulk than the other components 42, 43 and 44 so that the component 41 may serve as the body portion of the tadpole tape while the remaining components 42, 43 and 44 combine to serve as the tail portion. Depending upon the degree of difference between the bulk of the body portion and the tail portion, the tape components may be fabricated on the same machines with simply the substitution of a bulkier strand in the component 41 forming the body portion in comparison to the less bulky strands in the components 42, 43 and 44 forming the tail portion.

In this embodiment of the invention, the tape may be assembled in the same fashion as that set forth above in connection with FIGS. 1 and 2, following the schematic diagram of FIG. 6.

Thus, the tapes of the present invention are manufactured using the most economical fabrication techniques, namely circular knitting and sewing by sewing machine. The production rate of circular knitters is substantially greater than the production rate of braiding machines and by the use of the tubular knitting technique, the separate components of the fabrics are produced with substantial thickness caused by the doubling and overlapping effect achieved in the knitting operation.

In order to obtain fabrics of comparable thickness prior to the present invention, it was necessary to use multi-ply weaving techniques which in themselves are slow and provide problems in the fabrication operation, or to use braiding which is likewise slow and expensive. Furthermore, in the braiding apparatus, the strand material must be provided in a form which may be accommodated in the carriers of the braiding machine. The conventional bobbins of a braiding machine render it impractical to use yarns of any substantial bulk.

In the preferred embodiment of the invention the individual components of the composite fabric are tubular knit with only four needle wales and through selection of a fabric of this character, it has been found that each component itself provides a highly compact structure in which the strand material, in this case the four individual strands, are capable of completely filling the central portion of the tubular material so as to provide a dense fabric of substantial thickness and wherein the density of the fibrous material and the strands is effective to eliminate any voids or open spaces within the body of the fabric. The knitted structure provides a compact bundle of knitted loops having a large number of air spaces in it but which provides substantial impediment to direct airflow through the material so that the material may serve as an effective sealing element. The fibrous nature of the structure, on the other hand, does permit breathing of the fabric and permits escape of air through the seal when subjected to a substantial increase in pressure.

The zigzag stitching provided by the seams between the juxtaposed components tends to maintain the components in the flattened state which they assume during the stitching operation, but the fibrous nature of the components permits them to have sufficient resilience to serve as an effective sealing element which may conform to variations in surfaces between which the sealing element is positioned.

It has been found that the lengthwise extensibility and widthwise inextensibility of the composite fabric permits the tape to be laid flat around a corner. For the purpose of providing maximum tape effectiveness, it has been found that the width of the composite tape should be less than one-third of the radius of curvature of the sharpest curve to which the tape is subjected.

The tape of the present invention is also highly effective for wrap-around framing for glass inserts and the like, wherein the tape is wrapped around the edge of the glass insert prior to its insertion into the frame. The same tape thereby serves as a framing gasket for both surfaces of the glass insert. The lengthwise extensibility of the tape of the present invention enables the tape to be wrapped continuously around the perimeter of a glass insert without bunching and to thereby provide a firm seat for the insert in its frame.

The following are examples of composite fabric construction which have been found preferred for certain end uses.

EXAMPLE I

To produce a framing gasket for mounting a glass insert within a frame, for example mounting an oven inspection window within the door of the oven, the following procedure may be used. Starting with one strand per needle composed of 2 ends of 45 count-US (approximately 110 TEX) fiberglass roving as the feed supply, knit 12 lengths of tubular knitted fabric components on an 18 ga Lamb knitter-braider having an approximately one-half inch cylinder with four needles and four feeders. Knit the fiberglass roving into the tubular component at 12 courses per inch with a fabric takeoff at the rate of two feet per minute. The product from two knitters are fed side-by-side in pairs through a sewing machine having a zigzag chain stitch positioned to provide a lateral throw of $\frac{1}{8}$-inch and a stitch length of 5/32-inch to thereby interconnect the pair of tubular components side-by-side. These pairs are then fed through a similar sewing machine to interconnect the pairs side-by-side repeatedly until six of such pairs are interconnected to thereby produce a composite fabric composed of 12 tubular knit interconnected juxtaposed components. A predetermined length of this composite fabric is produced so that it may be cut to a length corresponding to the perimeter of the window which is to be mounted in the frame within the door of the oven.

The tape of this Example has a width of $2\frac{1}{4}$ inches and a thickness of approximately 3/16 inch and is capable of laying flat with around a radius of seven inches. When folded over the edge of the window glass inserted into the oven, it follows a curvilinear path having a radius of approximately four inches without generating any substantial creases or wrinkles in the turn.

EXAMPLE II

To produce a tadpole tape for sealing the perimeter of an oven door, one strand per needle consisting of 2 ends of 45 count-US fiberglass roving is fed to four knitting machines of the type set forth in Example I and the machines are adjusted in the same manner as set forth in Example I. In addition, one strand per needle composed of 4 ends of 45 count-US fiberglass roving is fed to a second knitting machine of the aforedescribed type and the knitting machine is adjusted to knit the fiberglass roving into the tubular component at 8 courses per inch with a fabric takeoff at the rate of 3 feet per minute.

The four tubular fabrics having the strand with 2 ends are interconnected by zigzag sewing as set forth above, and the composite fabric produced by these four fabrics are then juxtaposed with the tubular knit fabric from the single knitting machine producing tubular fabrics from strands with 4 ends per needle. The components are juxtaposed and interconnected by a seam produced in the sewing machine with the same settings as before to produce a tadpole tape.

The tadpole tape of this example has a keyhole shaped cross section with a width of $\frac{1}{2}$-inch, the body portion occupying approximately $\frac{3}{8}$-inch and the tail portion occupying approximately $\frac{1}{2}$-inch. The thickness of the tail portion is approximately $\frac{1}{8}$-inch, whereas the thickness of the body portion when flattened is approximately $\frac{1}{4}$-inch.

The foregoing examples are only two of the wide number of variations that are effective within the scope of the present invention. It has been found that the 18 ga cylinder knitter-braider is effective to knit bundles of fiberglass filaments, including yarns and rovings ranging in size from approximately 45 count to 10 count and a 2.5 ga knitter-braider having 4 needles in the circumference of a 1-$\frac{1}{8}$-inch cylinder with 4 feeders can knit strands ranging in size from approximately 45 count-US to 1.1 count-US. The latter machine may also knit strands which in themselves are tubular knit strands from the smaller diameter machine where it is desirable to obtain a high-density component of substantial bulk.

While particular embodiments of the present invention have been herein illustrated and described, it is not intended to limit the invention to these specific embodiments. Changes and modifications may be made therein and thereto within the scope of the appended claims.

I claim:

1. A bulky composite fabric having a uniform width throughout its length and composed of a given number of groups of strands of fibrous material, each of said groups of strands being interknitted to form an elongated tubular fabric component, whereby said given number of groups form a given number of said components, said tubular fabric components being juxtaposed and interconnected side-by-side throughout their length in pairs by seams of zigzag stitching extending diagonally alternately between said juxtaposed fabric components, each of said components comprising a knitted fabric tube of small diameter, each said tubular fabric component having a plurality of wales of needle loops extending longitudinally of said fabric, any given wale of needle loops having loops alternating in sequence between loops of first and second strands of fibrous material throughout the length of the fabric, the first of said strands alternately forming needle loops in a wale on one side of the given wale and the second of said strands alternately forming needle loops in a wale on the other side of said given wale a first of said components being fabricated of strands of fibrous material of substantially greater bulk than the strands making up a second fabric component, whereby the thickness of said bulky composite fabric is greater along the line of the first component than along the line of said second component.

2. A composite bulky fabric according to claim 1 wherein said given number of fabric components are knitted tubes each having one needle wale for each strand in said group, said wales being disposed circumferentially of the tube, said knitted tubes being sufficiently compact to dispose the interior sides of at least two opposite needle wales in face-to-face surface abutment.

3. A composite bulky fabric according to claim 1 wherein said composite fabric comprises at least three of said fabric components, one of said components along one side of the fabric being fabricated of strands of fibrous material of substantially greater bulk than the strands making up the fabric component of the remaining fabric components, whereby said composite fabric constitutes a tadpole tape having a keyhole-shaped cross section.

4. A composite fabric according to claim 1 wherein there is at least one strand in each group for each needle wale in each tubular component.

5. A composite fabric according to claim 4 wherein each tubular component consists of four needle wales and consists of four strands, each strand forming loops alternately between two adjacent wales.

6. A composite fabric according to claim 1 wherein each strand comprises a bundle of fiberglass filaments.

7. A composite fabric according to claim 6 wherein each strand is an untwisted roving having a fiberglass yarn count in the range of approximately 1.1 to 45 inclusive.

8. A composite narrow fabric according to claim 1 wherein each of said seams comprises a line of stitches disposed in a zigzag array between said juxtaposed components.

9. A composite narrow fabric according to claim 8 wherein said seam stitches comprise chain stitches formed by a single thread in each seam.

10. A method of making a bulky narrow fabric comprising the steps of knitting a plurality of seamless tubes of circular warp knit fabric, at least one of said tubes being knitted with strand material of substantially greater bulk than another of said tubes to provide circular knitted tubes of different bulk, feeding said tubes into juxtaposed side-by-side relationship, stitching said tubes together along their junction line to form a fabric having a width corresponding to the combined widths of the knit tubes, and a thickness which varies across its width, in accordance with the bulk of the seamless tube forming the narrow fabric at the point across its width, the bulkiest tube being along the edge of the composite fabric.

11. A bulky composite fabric having a uniform width throughout its length and composed of a given number of groups of strands of fibrous material, each of said groups of strands being interknitted to form an elongated tubular fabric component, whereby said given number of groups form a given number of said components, said tubular fabric components being interconnected throughout their length in pairs by zigzag stitching extending between said fabric components, at least two of said components comprising a bulky knitted fabric tube of small diameter, each said bulky tube having a plurality of wales of needle loops extending longitudinally of said fabric, any given wale of needle loops having loops alternating in sequence between loops of first and second strands of fibrous material throughout the length of the fabric, the first of said strands alternately forming needle loops in a wale on one side of the given wale and the second of said strands alternately forming needle loops in a wale on the other side of said given wale at least one of said bulky knitted fabric tubes being composed of strands of fibrous material of substantially greater bulk than the strands making up a second tubular fabric component, whereby the thickness of said bulky composite fabric is greater along the line of the first component than along the line of said second component.

12. A composite narrow fabric comprising a given number of tubular-knit fabric components, at least two of said components being formed of bulky strands of substantial thickness and being closely knit so as to provide a compact bundle of knitted loops, said two fabric components having a non-run stitch pattern permitting lengthwise stretching but inhibiting widthwise extension, and means interconnecting said tubular-knit components parallel to one another with the longitudinal axes of said components being in a common plane, said composite fabric providing limited longitudinal extension within said plane and permitting arrangement of said composite fabric in a curvilinear path in said common plane while laying flat at least one of said bulky knitted fabric tubes being composed of strands of fibrous material of substantially greater bulk than the strands making up a second tubular fabric component, whereby the thickness of said bulky composite fabric is greater along the line of the first component than along the line of said second component.

* * * * *